United States Patent [19]

Petrovic

[11] Patent Number: 4,693,318

[45] Date of Patent: Sep. 15, 1987

[54] SAND CONTROL DEVICES AND METHOD OF INSTALLATION THEREOF

[75] Inventor: Ljubisa M. Petrovic, Houston, Tex.

[73] Assignee: Well Improvement Specialists, Inc., Houston, Tex.

[21] Appl. No.: 786,050

[22] Filed: Oct. 10, 1985

[51] Int. Cl.[4] ..... E21B 43/08

[52] U.S. Cl. ..... 166/380; 166/236; 166/228; 175/22; 175/314

[58] Field of Search ..... 166/378, 380, 56, 227, 166/228, 236, 278; 175/22, 314

[56] References Cited

U.S. PATENT DOCUMENTS

| | | | |
|---|---|---|---|
| 1,004,528 | 9/1911 | Berky . | |
| 1,839,044 | 12/1931 | Minyard . | |
| 1,874,035 | 8/1932 | Fletcher . | |
| 2,978,033 | 4/1961 | Pitcher et al. | 166/228 |
| 3,145,778 | 8/1964 | Grekel et al. | 166/236 |
| 3,312,349 | 4/1967 | Rosaen . | |
| 3,618,771 | 11/1971 | Akers et al. | 210/95 |
| 3,965,981 | 6/1976 | D'Amiano | 166/228 |
| 4,064,938 | 12/1977 | Fast | 166/236 |
| 4,526,230 | 7/1985 | Kojicic | 166/236 |

FOREIGN PATENT DOCUMENTS 7712759 5/1979 Netherlands .

*Primary Examiner*—Stephen J. Novosad
*Assistant Examiner*—William P. Neuder
*Attorney, Agent, or Firm*—Lowe, Price, Leblanc, Becker & Shur

[57] ABSTRACT

A well screen filter is formed with inner and outer concentric screens defining an annular filtering space filled with filtrating medium. A lower perforated plate supporting the filtrating materials has passages allowing transit of fine particles entrained into the filter with formation fluid to a sedimentation tube preventing clogging of the filtering pack. A top perforated plate may be provided to prevent clogging of upper back areas. Openings in the outer screen extend elevationally higher than corresponding openings in the inner screen so that as the filtrating materials compact during production the inner screen openings always remain covered by the pack. A method of installing the sand control filter is also disclosed, utilizing a wash down media of glass or polymer spheres surrounding the filter to assist in stabilization of formation sand when the well is initially placed in production. A jet shoe connected to the sand filter is also disclosed for directing working fluid in upward and downward directions to displace the wash down media into position surrounding the filter.

22 Claims, 8 Drawing Figures

SAND CONTROL DEVICES AND METHOD OF INSTALLATION THEREOF

TECHNICAL FIELD

The present invention relates generally to sand control devices employed in oil, gas and water wells to prevent sanding and silting in and, more particularly, to a novel sand control filter and method of installing same opposite a fluid producing formation.

BACKGROUND ART

In U.S. Pat. No. 4,526,230 to Bozidar Kojicic, there is disclosed a double walled screen filter that includes a pair of substantially spaced concentric screens defining an annular filter space. The screens are connected with a lower perforated plate closing the lower end of the filtering space. The annular space is filled with filtrating materials, such as gravel or synthetic balls, as a filter pack and an upper joint acts as a cover cap of the annular filtering space to close the pack. When installed in a well bore opposite a fluid bearing formation, the lower perforated plate allows for passage of fine particles entering the filter into a sedimentation tube, preventing clogging of the pack and enabling proper functioning of the double walled screen filter. The sedimentation tube is connected below the lower perforated plate and particulate materials enter the filter with formation fluid through the outer screen.

The filter disclosed in the '230 patent provides numerous advantages over prior art filters of which I am aware, these advantages being set forth in the aforesaid patent, the disclosure of which is hereby incorporated by reference herein in its entirety. However, numerous disadvantages also occur with this prior art screen filter.

For example, an important feature of the Kojicic filter is the overall reduction of screen length and diameter due to the possibility of obtaining a high total open area and optimum hydraulic characteristics of the screen filter by virtue of having the openings in the inner and outer screen extend coextensively the entire length of the screen. The filtrating material which is loosely packed gravel or polymer balls fills the entire annular filtrating space, rising to a common elevational position as the upper openings formed in both the inner and outer screens. During production of formation fluid, however, compaction of the filtrating material occurs, resulting in a reduction of height of the pack, and exposing upper openings formed in both the inner and outer screen to a bare filtrating space. Thus, formation fluid entering the filter through the upper openings flows from the outer through the inner screen without being filtered by the pack. This unfiltered fluid containing large sand particles and other particulate material has a tendency to damage pumping and other production equipment when produced to the surface.

Another problem associated with the prior art filter is the tendency of upper portions of the filter pack to clog with sand filtered from the formation fluid. This upper portion is located remote from the lower perforated plate conducting sand from intermediate and lower filter pack portions into the sedimentation tube; however, depending upon hydraulic conditions, sand trapped within the upper portion of the pack cannot always flow through the pack into the sedimentation tube. Hence, clogging occurs.

Since the sand filter is of smaller diameter than the well bore into which it is placed, when such a well is placed on production, sand is eroded from the formation and is carried into the well by the high pressure flow of formation fluid produced concurrently therewith. This entrained sand must initially surround the filter to fill the annular space between the filter and well bore. Normally, the sand stabilizes around the filter. As the term is used herein, sand stabilization basically means settling of large sand grains and other particulate materials around the sand control filter wherein these large sand grains have sufficient open areas to permit flow of formation fluid into the filter. However, when the filter is initially placed within the bottom of the well bore with the well initially put on production, the entrained sand entering the space around the filter tends to severely erode the outer screen due to its abrasive characteristics, often rendering the screen filter useless and requiring immediate replacement.

Replacement of the sand control filter can also be a problem due to the presence of a tightly packed stabilized sand layer produced when the well is initially placed on production and entirely surrounding the filter. In other words, this tightly packed formation sand results in a high coefficient of friction between it and the outer screen of the sand filter requiring the use of heavy lift equipment when removal of the sand filter becomes necessary.

It is accordingly an object of the present invention to provide a sand control filter capable of consistently producing filtered formation fluid in spite of compaction of filtrating materials within the filter.

Another object of the invention is to provide a sand control filter in which clogging of the filtrating pack, particularly upper portions of the pack, does not occur.

Yet another object is to provide a method of installing a sand control filter which prevents abrasion and possible destruction of the outer screen from occurring during the sand stabilization process.

Yet a further object is to provide a method of installing a sand control filter both quickly and easily.

Still another object is to provide a method resulting in fast and easy retrieval of the filter when necessary without requiring heavy lifting equipment and a large labor force.

Yet a further object is to provide a filter which is rugged in design and capable of reliable operation in hostile environments.

DISCLOSURE OF INVENTION

In accordance with the present invention, there is disclosed a double walled sand control filter for installation in fluid bearing formations to prevent sanding and silting in during production of formation fluid. The sand control filter comprises a pair of inner and outer spaced, substantially concentric screens positioned to define an annular filter space therebetween. A filtrating medium occupies the annular filter space for filtering particulate materials from formation fluid flowing through it. These particulate materials entering the filter through the outer screen have a tendency to pass into the well. The filtrating medium during production tends to become compacted to thereby extend within the annular filter space from an initially filled maximum elevational position E1 to a compacted elevational position E2, wherein $E1 > E2$. In accordance with the invention, the filtrating medium is provided in sufficient quantity so that after compaction occurs the openings in the inner screen remain substantially entirely covered by filtrating medium so that formation fluid entering the filter always passes through the filtrating medium prior to entering the inner screen. A sedimentation area is formed below the filter into which particulate materials filtered from formation fluid withing the annular filter space pass to allow the filtrating medium to remain essentially unclogged by the particulate materials.

In accordance with one embodiment of the present invention, problems occurring due to compaction of the filtrating material are eliminated by forming the outer screen with openings extending to a maximum elevational position E1 higher than the maximum elevational position E2 of the openings formed in the inner screen. A portion of the inner screen extending upward from the inner screen openings is thus formed as an imperforate side wall extending coextensive with the outer screen openings from E1 to E2. The inner screen openings extending to position E2 remain substantially entirely covered by the compacted filtrating medium so that formation fluid entering the filter always passes through the filtrating medium prior to entering the inner screen.

A top plate preferably extends between the inner and outer screens to close off the upper end of the filter space and center the inner screen within the outer screen. In another embodiment of the invention, this top plate preferably contains perforations defining passages for enabling transit of fines and small particulate materials flowing through the filtrating medium to flow out of the medium and thereby prevent clogging of an upper portion of the filter pack. These fines and small particulate materials are produced to the surface with formation fluid but are sufficiently small to prevent damage to production and pumping equipment.

The filtrating materials are loosely packed into the annular filter space to extend to maximum elevational poistion E1. Preferably, the openings formed on the inner screen extend to cover a major portion of the length of the inner screen to provide maximum open flow area for formation fluid to obtain high production throughput.

In accordance with another aspect of the present invention, there is disclosed a method for installing a sand control device or filter within an existing well bore formed within a fluid bearing formation. The method comprises the steps of cleaning the well bore by removing sand tending to collect in the bottom of the well. A wash down media is then placed into the bottom of the well, the wash down media preferably consisting or loose glass beads of polymer spheres. Next, the filter is installed into the well carrying a wash pipe and sedimentation tube with a jet shoe connected below. The sand control filter is lowered into the well until the jet shoe contacts the upper surface of the wash down media. The sand control filter has an outer diameter less than the inner diameter of the well to define an annular space therebetween.

A working fluid is injected in sufficient quantities through the wash pipe for ejection through the jet shoe to displace the wash down media and allow the jet shoe to settle to the well bottom so that the sand control filter settles to a position coextensive and opposite fluid bearing formation zones and is entirely surrounded by the wash down media entering the annular space by the action of forceable displacement of the media by ejection of working fluid from the jet shoe. This wash down media tends to prevent abrasion of the sand control filter tending to be caused during initial production of formation fluid as the formation fluid initially enters the sand control filter through the annular space from the surrounding formation carrying abrasive formation sand with it. The wash down media traps between open spaces formed by adjacent spheres the large particles of sand and particulate material entrained with the formation fluid, resulting in stabilization of the sand around the filter and maximum flow characteristics of formation fluid through the filter.

The wash down media is preferably supplied in sufficient quantity to substantially entirely surround the filter by occupying the annular space between it and the well bore.

To prevent bridging of the wash down media between the sand control filter and well bore as the filter is lowered into working position by the action of working fluid displacing the media, the working fluid is preferably ejected from the jet shoe in both upward and downward directions to displace the wash down media, allowing it to enter the annular space and entirely surround the filter.

The jet shoe in accordance with the present invention comprises a body formed with an internal cavity housing a check valve permitting the downward flow of working fluid into the cavity while restricting any upper flow of working fluid from the cavity. The jet shoe is connectable to a source of working fluid. The body is further formed with a downwardly extending passage in communication with the cavity to direct working fluid in a downward direction form the shoe. The body further includes an upwardly extending passage in communication with the cavity to direct part of the working fluid out of the bottom of the shoe in an upward direction. This upward flow of working fluid prevents wash down media displaced by the downward flow of working fluid from bridging about lower portions of the sand control filter.

The upwardly and downwardly extending passages each include an outlet port formed in the bottom of the shoe. The outlet of the upwardly extending passage is located at an elevationally higher position than the outlet of the downwardly extending passage.

Preferably, the cavity is formed with upper and lower cylindrical cavity portions. The upper cavity portion contains the check valve and is of larger diameter than the lower cavity portion to establish a valve seat therebetween. The upwardly and downwardly extending passages each include an inlet port formed in the lower cavity portion. The bottom of the lower cavity portion is formed with a conical surface. The inlet port of the downwardly extending passage is formed in the conical surface proximate the apex thereof. The inlet port of the upwardly extending passage is formed at the intersection of the conical surface with the cylindrical side wall.

In accordance with yet another feature of the invention, there is disclosed an assembly for installation in fluid bearing formations to prevent sanding and silting in during production. The assembly comprises a pair of inner and outer spaced, concentric screens positioned to define an annular filter space therebetween containing a filtrating material for filtering sand and particulate materials having a tendency to pass into the well. An annular perforated plate is fixed to a lower portion of the outer screen. A sedimentation tube is connected to extend below the annular plate. The perforations in the plate provide communication between the annular filter space and sedimentation tube. A jet shoe connected to the lower end of the sedimentation tube supplies working fluid to properly position the screens opposite fluid formations by displacing a wash down media around the filter. A second plate is positioned between the inner and outer screens to close off the upper end of the annular filter space. A seating nipple is connected to extend upward from the outer screen. A wash pipe extends through the seating nipple and terminates within the sedimentation tube.

An upper end of the wash pipe has a hold down assembly formed with upper sealing members in sealing contact with the seating nipple. The upper seals prevent working fluid supplied to the jet shoe from flowing into the filter screens. The hold down assembly further includes stop means engageable in sealing contact with the nipple to limit the extent to which the wash pipe extends into the sedimentation tube, preventing excessive penetration and damage to the jet shoe. A fishing neck is connected to the hold down assembly to define the upper extent of the wash pipe. The fishing neck is engageable with a retrieving tool to withdraw the hold down assembly and wash pipe from the inner screen and sedimentation tube through the seating nipple after installation of the filter within the well. Lower sealing members provide sealing contact of the lower end of the wash pipe within the sedimentation tube to prevent working fluid pumped through the wash pipe for ejection through the jet shoe from passing upward through the sedimentation tube into the annular filter space.

Still other objects of the present invention will become readily apparent to those skilled in this art from the following description wherein there is shown and described preferred embodiments of this invention simply by way of illustration of one of the best modes contemplated for carrying out the invention. As will be realized, the invention is capable of other different embodiments, and its several details are capable of modifications in various, obvious respects, all without departing from the invention.

BRIEF DESCRIPTION OF THE DRAWING

FIGS. *6a–6b* are partial cross-sectional views showing installation of the filter within a protective wash down media.

BEST MODE FOR CARRYING OUT THE INVENTION

Figure 1:
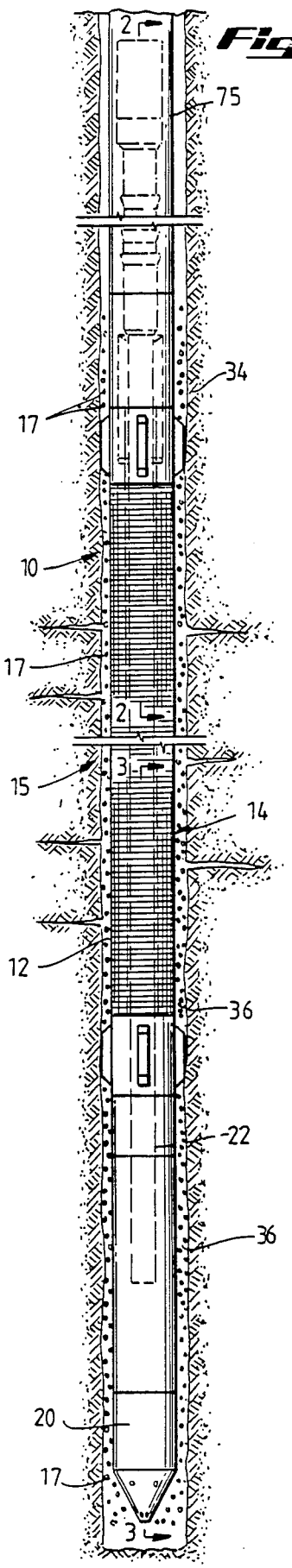
FIG. 1 is a partial elevational and cross-sectional view of the sand control filter and wash down assembly in position within a well bore.

In FIG. 1, there is shown a sand control and installation apparatus 10 of the present invention installed within a cased or uncased well bore 12. The apparatus 10 comprises a sand control filter 14 located opposite fluid formation zones 15 and surrounded by a wash down media 17 consisting of glass beads or polymer spheres. In accordance with the present invention, the wash down media 17 allows formation sand entering the well with formation fluid to stablize around filter 14 while protecting the filter from abrasion during the stabilization process. A unique jet shoe 20 assists in proper placement of filter 14 within wash down media 17 by displacement of media about the filter under the action of a working fluid (e.g., water) supplied to the shoe from a wash pipe 22. The wash pipe 22 uniquely cooperates with various elements of apparatus 10 discussed infra to provide working fluid to the jet shoe without requiring a pipe string extending from apparatus 10 to the surface.

Figure 2:
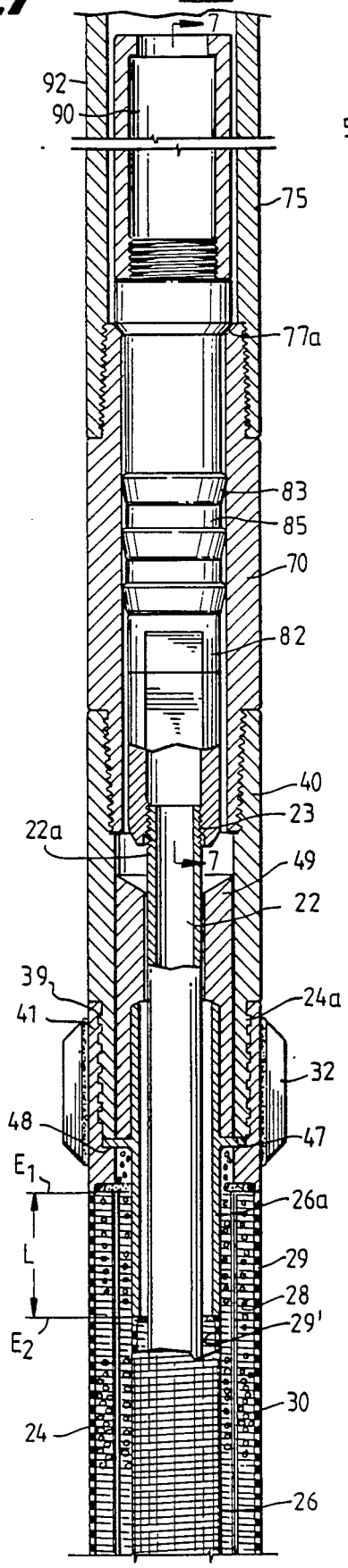
FIG. 2 is a sectional view taken along the line 2—2 of FIG. 1 of a portion of the assembly of FIG. 1.
Figure 3:
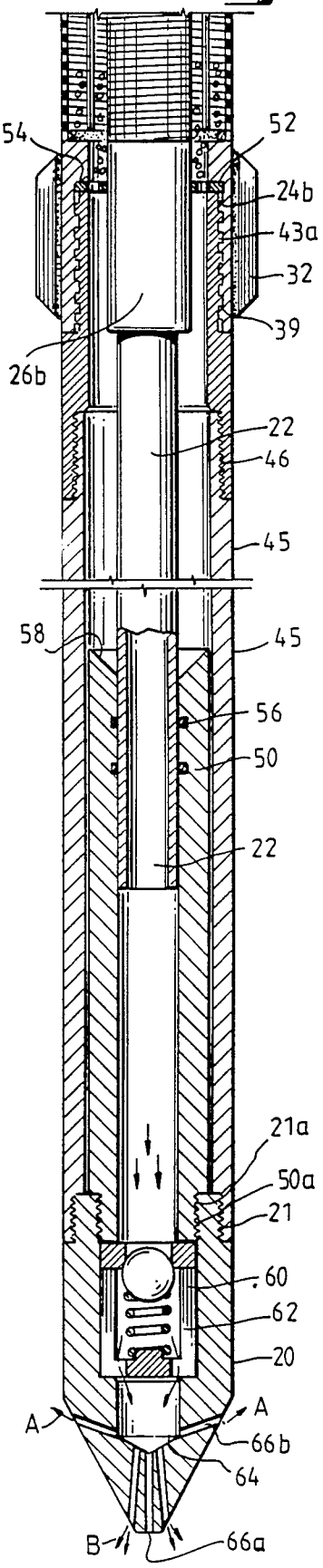
FIG. 3 is a sectional view taken along the line 3—3 of FIG. 1 of a lower portion of the assembly.
Figure 4:
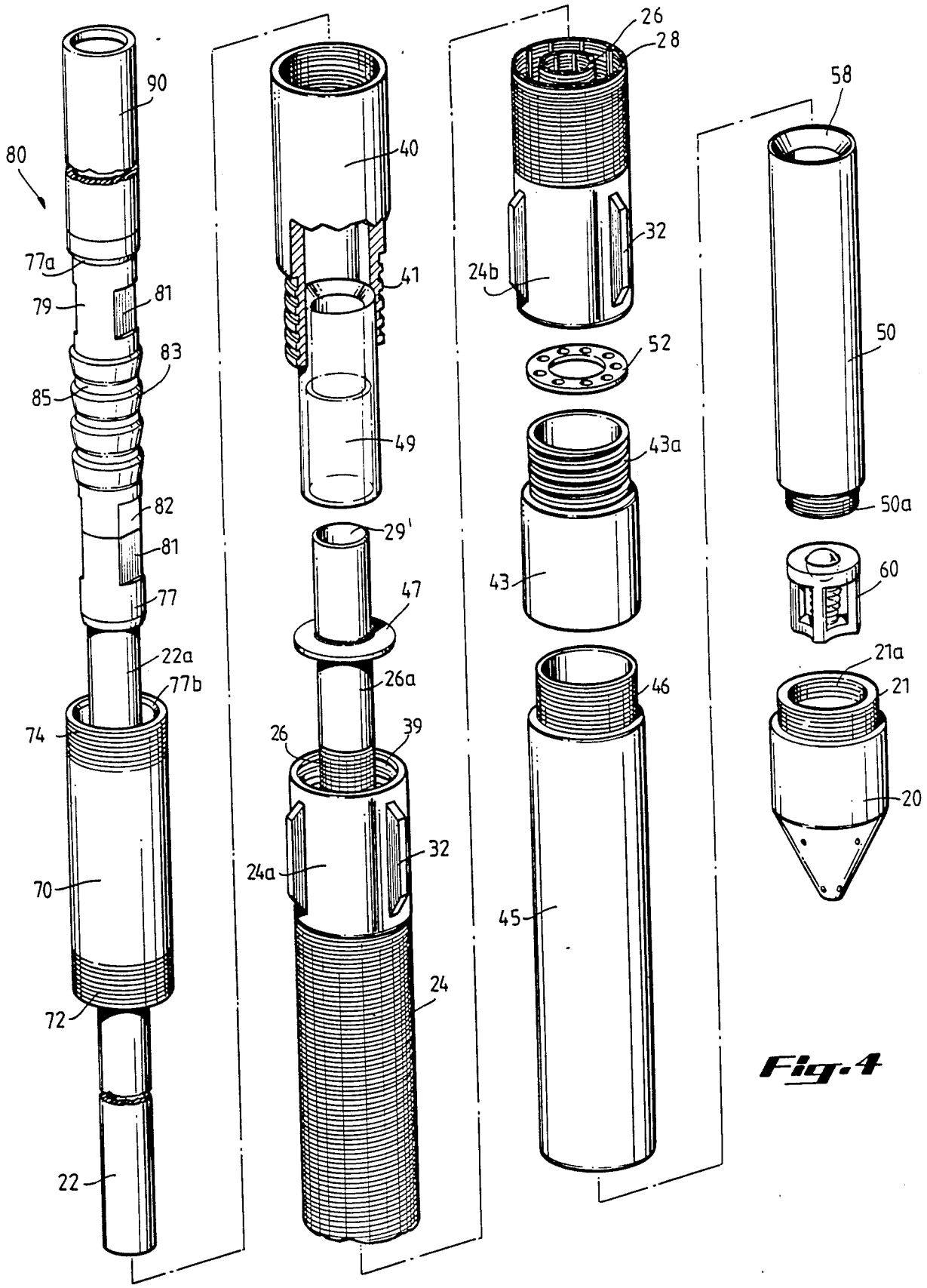
FIG. 4 is an exploded perspective view of the assembly of FIG. 1 depicting a first embodiment thereof.

Referring to FIGS. 2–4, sand control filter comprises concentric outer and inner screens 24, 26 defining an annular filter space 28 therebetween. The screens 24, 26 are formed with openings 29 to permit the flow of formation fluid from surrounding formation zones 15 into the inner screen bore 29' where fluid is produced to the surface in a sand-free condition by virtue of flowing through filtrating pack 30 within space 28. The screen openings 29 and the loosely packed filtrating materials may be of the type disclosed in U.S. Pat. No. 4,526,230 incorporated by reference herein in its entirety.

Outer screen 24 is preferably formed with upper and lower cylindrical mounting sections **24*a* and 24*b* respectively carrying on an outer surface thereof longitudinal fins 32 centering the outer screen within the well casing 34 to define an annular space 36 extending the length of the screen and filled with wash down media 17 as discussed infra. The upper section 24*a* has internal threads 39 connected to external threads 41 formed on the lower end of a top sub 40 described infra. The lower section 24*b* of outer screen 24 also includes internal threads 39 connected to external threads 43*a* formed at the upper end of a coupling pipe 43 connecting the outer screen to a sedimentation tube 45 at 46**.

Inner screen 26 is also formed with upper and lower cylindrical imperforate sections **26*a* and 26*b*. The upper section 26*a* extends coaxially within upper section 24*a* of the outer screen and is formed with an annular top plate 47 closing off the upper end of annular filter space 28 and centering the inner screen within the outer screen. Top plate 47 is seated within an upwardly directed seat 48 formed below internal threads 39 and held in position by the lower end of top sub 40 and an upper wash pipe guide 49 coaxially mounted within the top sub. The upper wash pipe guide 49 has an internal diameter greater than the external diameter of wash pipe 22 and serves to guide the wash pipe downwardly through the inner screen into sealing contact within a wash pipe sealing tube 50 coaxially mounted within sedimentation tube 45 as discussed infra. A bottom perforated plate 52 positioned adjacent the lower imperforate section 26*b* of the inner screen supports the filtrating pack 30 within annular space 28. The bottom plate 52 is held against a downwardly directed seat 54 formed within the internal surface of lower section 24*b* of the outer screen above internal threads 39 and held in position by the upper end of coupling pipe 43 pressing upwardly against the bottom plate. The lower imperforated section 26*b* of the inner screen extends through plate 52, as depicted in FIG. 3**.

Operation of filter 14 is as set forth in the '230 patent to Kojicic. Namely, formation fluid entering the bore 29' of inner screen 26 must first pass through the filtrating medium 30, i.e., through the open spaces thereof, where sand particles and other particulate materials become entrapped allowing the formation fluid to enter the inner screen in virtually sand-free condition. These trapped particles migrate downwardly through the pack where they pass through perforations formed in lower plate 52 to enter sedimentation tube 45. Thus, filtrating pack 30 remains virtually unclogged and therefore has excellent fluid transmitting properties and long life.

When the well is placed in production, the loose filtrating medium 30 tends to compact to a lower elevational position than the initially filled position, leaving upper portions of openings 29 of the inner and outer screens in open communication with each other through a resulting free space in the upper end of the annular filter space. Formation fluid entering the filter through these exposed upper openings allow unfiltered formation fluid to pass through the inner screen causing sand and other large particulate materials to be produced to the surface entrained with formation fluid where they eventually wear out production and pumping equipment. In accordance with an important feature of the present invention, inner and outer screens 24, 26 are preferably formed and mounted together such that the openings within the outer screen extend to a maximum elevational position E1 higher than the maximum elevational position E2 of the openings in the inner screen. Thus, a portion of the inner screen extending upward from the inner screen openings forms part of imperforate section 26*a* extending coextensive with the outer screen openings within region L. The region L is calculated such that compacted filtrating medium 28 does not settle to a position lower than E2. Thus, the inner screen openings always remain entirely covered by the compacted filtrating medium so that formation fluid entering the filter through the outer screen always passes through the filtrating medium prior to entering the inner screen.

Although it is possible to maintain the inner screen openings completely covered by filtering medium by increasing the quantity of filtrating medium within annular filter space 28, this necessitates increasing the length of the inner and outer screens which is generally undesirable from the standpoint of increased manufacturing and installation costs.

Figure 5:
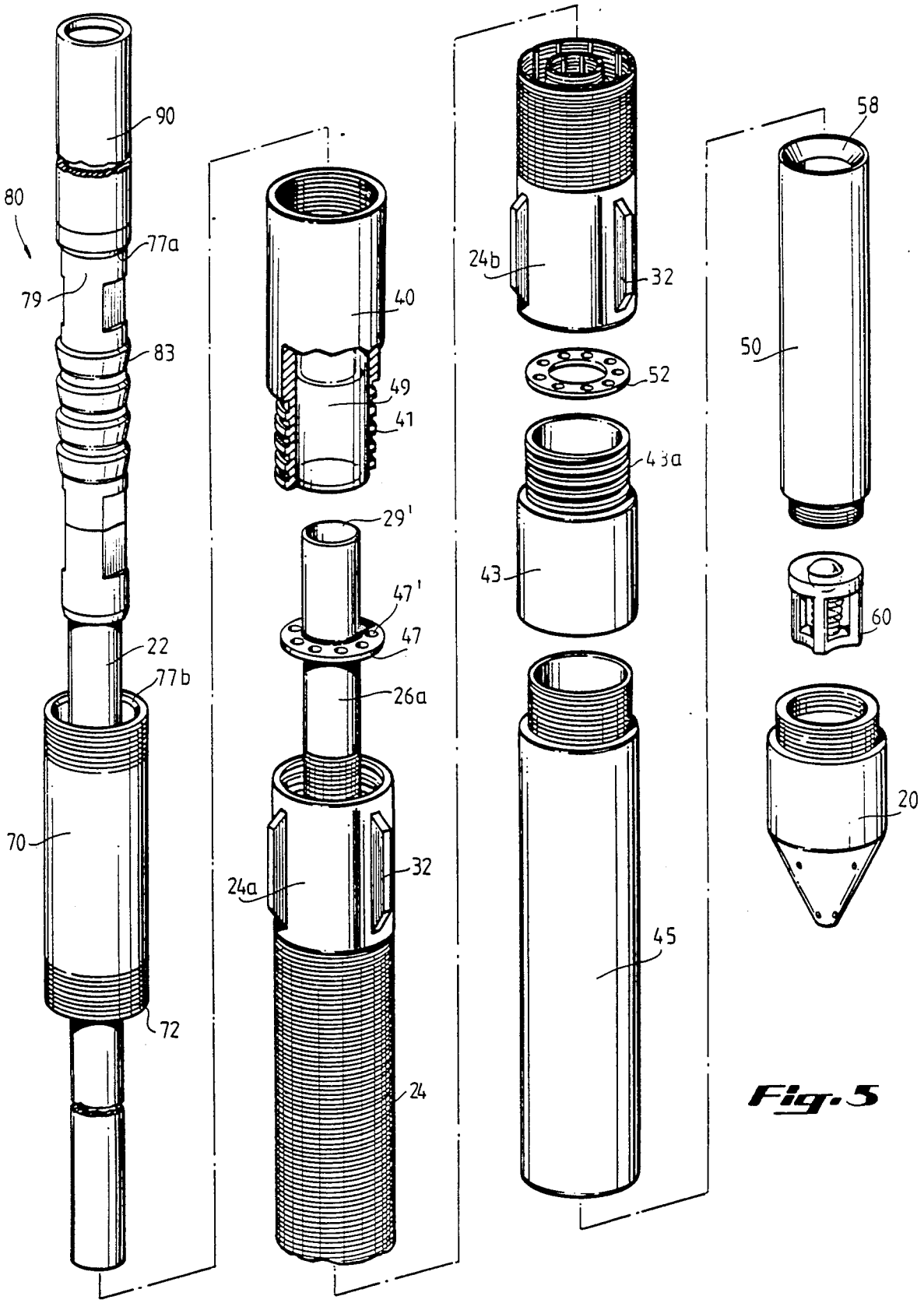
FIG. 5 is an exploded perspective view similar to FIG. 4 depicting a second embodiment of the invention.

FIG. 5 illustrates a second embodiment of filter 14 wherein top plate 47 includes perforations 47' of the type formed in bottom perforated plate 52. With this embodiment, upper wash pipe guide 49 may be eliminated to expose the perforations 47' to an annular space located thereabove between top sub 40 and imperforate section 26*a* so that formation fluid passing through perforations 47' after flowing through pack 30 enters the well bore 29' by flowing through this annular space and upwardly around the upper end of the inner screen where it is produced to the surface. Alternatively, guide 49 may be retained with the lower end thereof spaced upwardly from the plate 47 exposing a portion of inner screen 26 extending upward from the top plate to the perforations 47'. This portion of upper section 26*a* may include openings 29 (not shown). With either embodiment, upper imperforate section 24*a* of outer screen 24 is slightly longer than that disclosed in the FIG. 4 embodiment of the invention allowing additional filtrating medium 30 to be placed within filter space 28 so as to fully cover both the inner and outer screen openings 29 upon compaction.

The feature of forming top plate 47 with perforations 47' advantageously allows fines and small particulate materials tending to clog the upper end of tilter pack 30 to flow through the filter pack through perforations 47' with formation fluid thus leaving the entire filter pack in an unclogged condition. It should be noted that these fines and small particulate materials are sufficiently small to avoid wearing out the production or pumping equipment.

As mentioned briefly above, sedimentation tube 45 preferably may have internal threads 50*a* at a lower end thereof connected to external threads provided on an upper annular mounting portion 21 of jet shoe 20. Internal threads 21*a* on mounting portion 21 are threaded to external threads 50*a* on the lower end of wash pipe sealing tube 50. The sealing tube 50 is formed at an upper interior cylindrical surface thereof with grooves containing O-ring seals 56 in sealing contact with the lower end of wash pipe 22 terminating within the cylindrical bore of the seating tube. Pipe 22, as described more fully below, supplies working fluid directly to jet shoe 20. The O-ring seals 56 prevent working fluid from flowing upward into filter 14 through bottom perforated plate 52 during the filter installation process, which working fluid in turn may flow outwardly through the outer screen 24 instead of flowing through jet shoe 20. The upper end of sealing tube 50 further includes a conical surface 58 converging toward the seals to guide the lower end of wash pipe 22 into proper sealing contact with the tube.

Jet shoe 20 is in direct communication with the lower end of wash pipe 22 to receive working fluid supplied through sealing tube 50. More specifically, as best shown in FIG. 3, fluid enters the jet shoe through a check valve 60 disposed within an upper cylindrical cavity 62 of the shoe. The working fluid flows through the cavity where it enters a lower cylindrical cavity 64 for ejection through the bottom of the shoe through passages 66*a*, 66*b*. A reverse flow of fluid during production is advantageously prevented by the check valve.

Figure 6A:
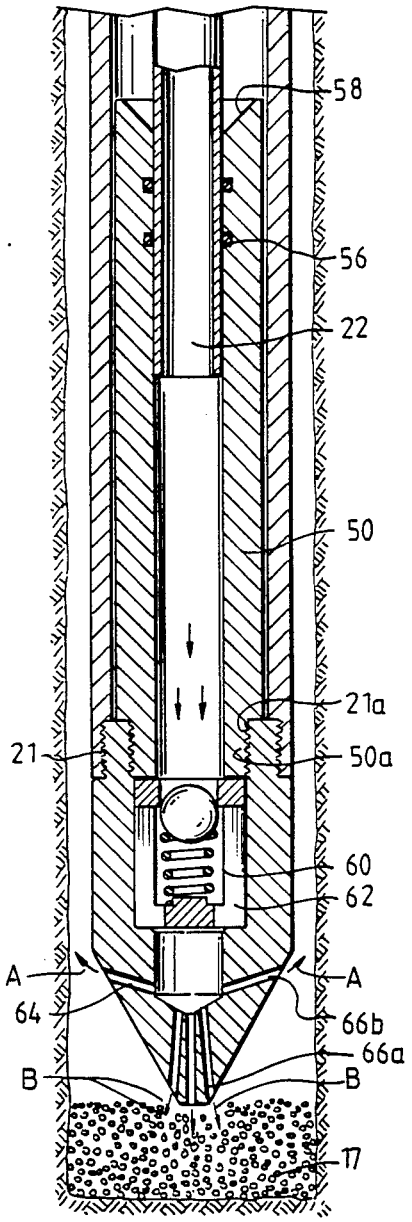
Figure 6B:
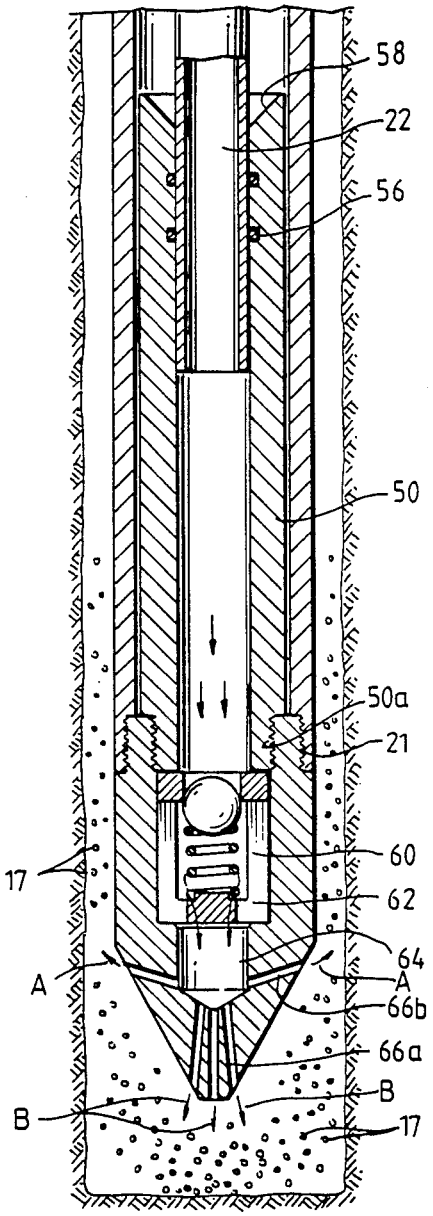

The upper passages 66*b* in jet shoe 20 are unique in causing part of the working fluid entering the passages to be upwardly directed in the direction of arrows A while the remaining part of working fluid is ejected downwardly from the shoe through passages 66*a* in the direction of arrow B. During installation of sand control filter 14, working fluid ejected from shoe 20 causes displacement of wash down media 17 to entirely surround the filter. This wash down media is initially placed in the bottom of the well with apparatus 10 lowered into the well until shoe 20 contacts the upper surface of media 17 as shown in FIG. 6*a*. Forceable displacement of wash down media about filter 14 then occurs by the action of working fluid to allow filter 14 to settle in proper position opposite fluid producing zones 15 as shown in FIG. 1. The upward flow through passages 66*b* prevents wash down media from bridging between the shoe and well casing (FIG. 6*b*) that would otherwise prevent proper settling and installation of the filter into the well.

The top sub 40, as mentioned above, is threaded to the upper end of outer screen 24 to connect the filter 14 to a seating nipple 70 via threads 72. The upper end of seating nipple 70 is formed with external threads 74 threaded to the lower end of an upper coupling member 75 defining the uppermost extent of sand control and installation apparatus 10. It should be understood that seating nipple 70 and upper coupling member 75 connected to the filter through top sub 40 remain connected and in situ with the filter following removal of the wash pipe string 22 as discussed below.

Figure 7:
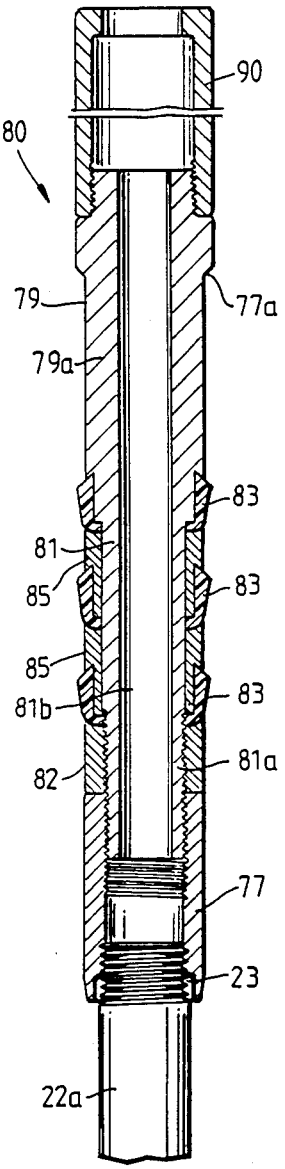
FIG. 7 is a cross-sectional view of a wash pipe hold down assembly taken through the line 7—7 of FIG. 2.

With reference to FIGS. 2, 4 and 7, the uppermost end 22*a* of wash pipe 22 is threaded at 23 or otherwise fixed to a first connecting member 77 connected to a hold down body 79. The body 79 has a cylindrical body portion 79*a* and a smaller diameter connecting pipe 81 depending downwardly therefrom formed with a lower threaded portion 81*a* and an unthreaded portion 81*b*. A series of longitudinally spaced sealing cups 83 are provided on unthreaded portion 81*b* for sealing contact with the internal periphery of seating nipple 70. Cups 83 are spaced from each other with spacers 85. A locknut 82 threaded to portion 81*a* secures cups 83 and spacers 85 in position with element 77 secured to the lower end of the threaded portion to provide interconnections with wash pipe end 22*a*. Flats 81 may be provided on the exterior surfaces of elements 77, 79 and 82 to facilitate tightening and untightening of these elements. Hold down body 79 is provided with a downwardly facing conical surface 77*a* of greater diameter than the upper internal diameter of seating nipple 70 formed with a conical stop surface 77*b* to limit the extent to which hold down assembly 80 extends into seating nipple 70. The stop action provided by stop surface 77*b* also limits the extent to which wash pipe 22 enters wash pipe seating tube 50 in sealing contact with rings 56 to prevent excessive penetration of the wash pipe into, for example, jet shoe 20 that may otherwise impair operation of the jet shoe during the installation process.

As mentioned above, annular sealing cups 83 provide sealing contact with the internal periphery of seating nipple 70 when the wash pipe string is inserted into proper position through the filter and installation apparatus, i.e., when the lower surface 77*a* of hold down body 79 engages stop surface 77*b* of the seating nipple 70. These sealing cups or rings 83 serve to prevent working fluid supplied from the surface into the well bore from flowing around the wash pipe 22 where it might enter the outer screen through the inner screen and filtrating pack 30. In other words, sealing rings 83 ensure that working fluid supplied to install filter 10 properly enters the wash pipe for supply to jet shoe 20 instead of flowing around the wash pipe string 22 into the filter.

A fishing neck 90 may be threaded to and project upward from hold down body 79 to define the uppermost extent of the wash pipe string. Fishing neck 90, which is of well known construction, is engageable with a known lifting tool (not shown) for raising and lowering the wash pipe string within the filter and installation apparatus.

Assembly and installation of sand control and installation apparatus 10 is easy. First, wash pipe seating tube 50 and sedimentation tube 45 are threaded to upper mounting portion 21 of jet shoe 20. Next, inner screen 26 is inserted into outer screen 24 and is maintained coextensive with the outer screen to define annular filtering space 28 via centering engagement of top plate 47 with stop surface 48 formed in the upper portion of the outer screen (FIG. 2). Upper wash pipe guide 49 is slip-fitted onto the upper end of the inner screen and locked into position with top sub 40. The filtering media 30 is then placed within filtering space 28; lower perforated plate 52 is installed to close off the lower end of the filtering pack and is secured in position with coupling pipe 43 threaded into the lower end of the outer screen. Connector 43 is then secured to the upper end of sediment tube 45. Seating nipple 70 is then secured to the upper end of top sub 40.

Wash pipe string 22 including hold down assembly 80 and fishing neck 90 is then installed within the filter structure until the seating nipple stop surface 77*b* contacts surface 77*a* at which time the lower end of wash pipe 22 is in proper sealing contact with lower sealing rings 56 while sealing rings 83 provided on hold down assembly 80 provide upper sealing contact between the wash pipe string and seating nipple. Upper pipe 92 is then connected to seating nipple 70 with coupling 25 to complete the sand control device and installation structure, which may then be inserted into the well bore using conventional equipment.

With wash pipe string 22 and the structure of sand control and installation apparatus 10 described supra, it will be appreciated that the wash pipe string does to extend the surface and instead terminates in fishing neck 90 located coextensively within the upper end of the installation apparatus. Thereafter, working fluid may be pumped from the surface down into the well bore to displace the wash down media using jet shoe 20 in the manner described above without inadvertently flowing into the sand control filter. Thereafter, the wash pipe string 22 may be withdrawn using conventional equipment engaging fishing neck 90 so that the well may then be placed on line.

It well be appreciated that various modifications may be made to sand control and installation apparatus 10 without departing from the scope of the present invention. For example, it is possible to form the sand control filter without a sedimentation tube and bottom perforated plate in which case the outer screen filter 24 may be connected directly to the upper end of jet shoe 20. Although particulate material otherwise entering sedimentation tube 45 through lower perforated plate 52 would then be caused to collect within filtrating pack 30, eventually causing clogging of the filtrating pack it is nonetheless possible to remove the sand control filter for periodic servicing (i.e., cleaning) since the glass beads forming wash down media 17 have a relatively low co-efficient of friction with the sand control filter allowing for easy removal thereof without destroying the filter.

Although the foregoing descriptions indicates that either glass beads or polymer spheres are preferred materials for wash down media 17 and filtrating pack 30, I have found that technical quality glass beads are preferred over polymer spheres for several reasons. For example, glass beads are stronger in compressive strength than polymer spheres and are therefore more pressure resistant. Also, glass beads are more resistant to certain types of acid used in chemical treatment of wells. Additionally, glass beads are more temperature resistant than polymer spheres and are therefore preferred for use particularly in geothermal, steam flooding or fire flooding wells.

In addition, although most of the parts discussed above are disclosed as threaded together (box threads preferred), it will be appreciated that other types of connection (e.g., shear pins) may be employed for fixing various parts together. In certain applications (e.g., small diameter well holes), the use of shear pins is preferred to connect sedimentation tube 45 to the filter or coupling pipe 43 for easier retrieval of the sand control device, i.e., initial removal of the filter sometimes tending to shear the pins, followed by subsequent removal of the sedimentation tube.

In this disclosure, there are shown and described only the preferred embodiments of the invention, but as aforementioned, it is to be understood that the invention is capable of use in various other combinations and environments and is capable of changes or modifications within the scope of the inventive concept as expressed herein.

I claim:

1. A double walled sand control filter for installation in fluid bearing formations to prevent sanding and silting in during production, comprising:

(a) a pair of inner and outer spaced, substantially concentric screen members positioned to define an annular filter spaced therebetween adapted to contain a filtrating medium for filtering sand and particulate materials having tendency to pass into a well, said filtrating medium tending to be subjected to compaction during production of formation fluids;

(b) means for connecting said inner and outer screens together so that the openings within the outer screen extend to a maximum elevational position E1 higher than the maximum elevational position E2 of the openings in the inner screen, said openings formed on the inner screen extending elevationally to cover substantially the entire length of said inner screen excepting a portion of the inner screen extending upward from the inner screen openings being an imperforate side wall extending coextensive with the outer screen openings from E1 to E2, said inner screen openings extending to position E2 remaining substantially entirely covered by the compacted filtrating medium so that formation fluid entering the filter always passes through the filtrating medium substantially entirely in a horizontal direction without an appreciable velocity component in a vertical direction prior to entering the inner screen; and (c) means for defining a sedimentation area below the filter into which particulate materials filtered from formation fluid with the annular filter space pass to allow the filtrating medium to remain essentially unclogged by said particulate materials.

2. The filter of claim 1, wherein said connecting means includes a top plate extending between the inner and outer screens to close off the upper end of the filter space.

3. The filter of claim 1, wherein said connecting means includes a lower plate extending between the inner and outer screens to close off the lower end of the filter space and support the filtrating medium therewithin, said lower plate having passages for enabling transit of particulate materials in the filter space to said sedimentation area therebelow.

4. A double walled sand control filter for installation in fluid bearing formations to prevent sanding and silting in during production, comprising:

(a) a pair of inner and outer spaced, substantially concentric screen members positioned to define an annular filter space therebetween adapted to contain a filtrating medium substantially filling the annular filtering space for filtering sand and particulate materials having a tendency to pass into a well, said filtrating material tending to be subjected to compaction during production of formation fluid;

(b) a top perforate plate extending between the inner and outer screens above the uppermost extent of the filter pack to close off the upper end of the filter space, said top plate having passages for enabling transit of fines and small particulate materials flowing through the filtrating medium to flow out of said medium and thereby prevent clogging of an upper portion of the filter pack;

(c) means for connecting said inner and outer screens together; and wherein said top perforated plate is located at an elevational position E1 relative to the maximum elevational position E2 of openings in the outer screen, wherein E1>E2, said outer screen including an upper portion being an imperforate side wall extending from E1 to E2, said filtrating medium initially provided within the filtering space in sufficient quantity so that it initially extends to an elevational position between E1 and E2 and following compaction during production compacts to a maximum elevational position of at least E1 so that the outer screen openings remain substantially entirely covered by the compacted filtrating medium so that formation fluid entering the filter through the outer screen always passes through the filtrating medium prior to entering the passages of the top plate.

5. The filter of claim 2, wherein said top plate is imperforate.

6. A double walled sand control filter for installation in fluid bearing formations to prevent sanding and silting in during production, comprising:

(a) a pair of inner and outer spaced, substantially concentric screen members positioned to define an annular filter space therebetween with means closing off opposite ends of the space;

(b) a filtrating medium occupying the annular filter space for filtering particulate materials from formation fluid flowing through it, said particulate materials entering he filter through the outer screen and having a tendency to pass into a well, said filtrating medium during production tending to become compacted to thereby extend within the annular filter space from an initially filled maximum elevational position E1 to a compacted elevational position E2, wherein E1>E2;

said filtrating medium being provided in sufficient quantity so that after compaction to elevational position E2 the openings in the inner screen remain substantially entirely covered by filtrating medium so that formation fluid entering the filter always passes through said filtrating medium prior to entering the inner screen, wherein said openings formed on the inner screen extend elevationally to cover substantially the entire length of said inner screen.

7. The filter of claim 1, wherein said filtrating materials are initially and generally loosely packed into the annular filter space to extend to maximum elevational position E1.

8. A method for installing a sand control filter within an existing well bore formed within a fluid bearing formation, comprising the steps of:

(a) cleaning the well bore by removing sand tending to collect in the bottom of the well;

(b) placing a wash down media into the bottom of the well, said wash down media substantially consisting of loose glass or polymer spheres;

(c) installing into the well the sand control filter carrying a wash pipe and a jet shoe connected below the filter, said sand control filter being lowered into the well until the jet shoe contacts the upper surface of the wash down media, said sand control filter having an outer diameter less than the inner diameter of the well to define an annular space therebetween; and (d) injecting a working fluid in sufficient quantities through the wash pipe for ejection through the jet shoe to displace the wash down media and allow the jet shoe to settle to the well bottom, said sand control filter thereby settling into a common elevational position with fluid bearing formation zones and being entirely surrounded by the wash down media entering the annular space by the action of forceable displacement of the media by ejection of working fluid from the jet shoe, said wash down media tending to prevent abrasion of the sand control filter tending to be caused during initial production of formation fluid as said formation fluid initially enters the sand control filter through the annular space from the surrounding formation carrying abrasive formation sand with it, said wash down media thereby trapping between open spaces formed between adjacent spheres the large particles of sand and particulate material flowing from the formation fluid, said spheres of the wash down media having a low coefficient of friction with the sand control filter to allow for easy installation and removal of the filter for servicing without destroying the filter.

9. The method of claim 8, wherein the quantity of wash down media is sufficient to substantially entirely cover the filter by occupying the annular space between it and the well bore.

10. The method of claim 8, wherein working fluid is supplied through the jet shoe at a sufficient flow rate to displace the wash down media about the outer screen.

11. The method of claim 10, wherein said working fluid is supplied in sufficient quantity to obtain a settlement rate of the sand control filter through the wash down media.

12. The method of claim 8, wherein working fluid is ejected from the jet shoe in both upward and downward directions to displace said wash down media allowing it to enter the annular space and entirely surround the filter without bridging.

13. A wash down and filter assembly for installation in fluid bearing formations to prevent sanding and silting in during production, comprising:

(a) a pair of inner and outer spaced, concentric screens positioned to define an annular filter space therebetween containing a filtrating material for filtering sand and particulate materials having a tendency to pass into the well;

(b) an annular perforated plate;

(c) means for fixing said annular plate to a lower portion of said outer screen;

(d) a sedimentation tube connected to extend below said annular plate, the perforations in said plate providing communication between the annular filter space and sedimentation tube;

(e) a jet shoe connected below the sedimentation tube;

(f) a second plate positionable between said inner and outer screens to close off the upper end of the annular filter space;

(g) a seating nipple connected to extend upward from the outer screen;

(h) a wash pipe extending through the seating nipple and terminating within the sedimentation tube, and upper end of the wash pipe having a hold down assembly formed with an upper sealing means in sealing contact with the seating nipple, said upper sealing means preventing working fluid supplied to the jet shoe from flowing into the filter screens, and stop means engageable in seating contact with the nipple to limit the extent to which the wash pipe extends into the sedimentation tube to prevent excessive penetration of the pipe and damage to the jet shoe;

(i) a fishing neck connected to the hold down assembly to define the upper extent of the wash pipe, said fishing neck being engageable with a retrieving tool to withdraw the hold down assembly and wash pipe from the inner screen and sedimentation tube through the seating nipple after the sand control filter is installed within the well; and (j) lower sealing means providing sealing contact of the lower end of the wash pipe within the sedimentation tube to prevent working fluid pumped through the wash pipe for ejection through the jet shoe from passing upward through the sedimentation tube into the annular filter space.

14. The assembly of claim 13, wherein said outer screen is formed with upper and lower imperforate portions having fins formed on outer surfaces thereof for centralizing the outer screen within an in situ well casing.

15. The assembly of claim 14, wherein an inner cylindrical surface of the lower imperforate portion is formed with a downwardly directed seat receiving said perforated plate.

16. The assembly of claim 15, wherein said fixing means includes a coupling pipe having an externally threaded upper end connected to internal threads in the lower imperforate portion, whereby threaded contact sandwiches the lower perforate plate within and to define the lower extent of the annular filter space.

17. The assembly of claim 16, wherein said coupling pipe further includes an internally threaded lower end connected to external threads in the upper end of the sedimentation tube.

18. The assembly of claim 17, wherein said sedimentation tube includes an internally threaded lower end connected to external threads formed in the upper end of the jet shoe.

19. The assembly of claim 18, wherein said upper end of the jet shoe further includes inner threads, and further including a wash pipe seating tube a lower end of which includes external threads connected to the internal threads of the jet shoe, said lower sealing means including O-rings positioned within annular grooves formed in an upper portion of an inner cylindrical surface of said seating tube, the lower end of the wash pipe being in sealing contact with said O-ring seals.

20. The assembly of claim 19, wherein the upper imperforate portion of said outer screen includes internal threads, and further including a cylindrical top sub having a lower end formed with external threads connected to the internal threads of the upper imperforate portion of the outer screen, said top sub having an upper end formed with internal threads connected to a lower end of the seating nipple formed with external threads.

21. The assembly of claim 20, wherein said inner screen is formed with an upper imperforate portion having fixed thereto at an intermediate part thereof said second plate closing the upper end of the annular filter space, said second plate being sandwiched between the top sub and outer screen, and further including a cylindrical upper wash pipe guide sandwiched between said seating nipple and said second plate, said upper wash pipe guide having an inner cylindrical surface a lower portion of which being of larger diameter than an upper portion to define a seat therebetween, an upper end of the inner screen extending above the second plate being received and seated within said larger diameter portion.

22. A wash down and filter assembly for installation in fluid bearing formations to prevent sanding and silting in during production, comprising:

(a) a pair of inner and outer spaced, concentric screens positioned to define an annular filter space therebetween containing a filtrating material for filtering sand and particulate materials having a tendency to pass into the well;

(b) means positioned between said inner and outer screen for defining the upper and lower extent of said annular filtering space;

(c) a jet shoe connected below said inner and outer screens;

(d) a seating nipple connected to extend upward from the outer screen, said seating nipple including a longitudinal passage enabling a wash pipe to extend through the seating nipple and inner screen for termination above the jet shoe to supply working fluid to said shoe; and (e) upper and lower sealing means for (1) preventing a flow of working fluid supplied to the jet shoe from flowing between the seating nipple and around the wash pipe into the filter screens and (2) preventing working fluid flowing out of the wash pipe towards the jet shoe from backing up and flowing upwardly around the wash pipe into the filter screens.

* * * * *